US006883726B2

(12) United States Patent
Polk et al.

(10) Patent No.: US 6,883,726 B2
(45) Date of Patent: Apr. 26, 2005

(54) FLUID SPRAYER SYSTEM USING MODULATED CONTROL VALVE AND A POSITIVE DISPLACEMENT PUMP

(75) Inventors: Brannon Polk, Evansville, IN (US); John Story, Evansville, IN (US); Kent Stephen Hahn, Evansville, IN (US)

(73) Assignee: The Toro Company, Bloomington, MN (US)

( * ) Notice: Subject to any disclaimer, the term of this patent is extended or adjusted under 35 U.S.C. 154(b) by 0 days.

(21) Appl. No.: 10/264,671

(22) Filed: Oct. 4, 2002

(65) Prior Publication Data

US 2003/0132310 A1 Jul. 17, 2003

Related U.S. Application Data

(60) Provisional application No. 60/349,538, filed on Jan. 16, 2002, and provisional application No. 60/377,472, filed on May 3, 2002.

(51) Int. Cl.[7] ..... B05B 1/20

(52) U.S. Cl. ..... 239/159; 239/1; 239/172; 239/71; 239/163

(58) Field of Search ..... 239/159, 172, 239/1, 71, 155–156, 163

(56) References Cited

U.S. PATENT DOCUMENTS 3,239,148 A * 3/1966 Etnyre ..... 239/159
3,512,714 A * 5/1970 Phelps et al. ..... 239/159
3,599,866 A * 8/1971 Bolton ..... 239/163
3,662,953 A * 5/1972 Wiens ..... 239/159
3,782,634 A * 1/1974 Herman ..... 239/163
4,530,463 A * 7/1985 Hiniker et al. ..... 239/71
5,028,017 A * 7/1991 Simmons et al. ..... 239/172
5,134,961 A * 8/1992 Giles et al. ..... 239/71
5,433,380 A 7/1995 Hahn ..... 239/159
5,704,546 A * 1/1998 Henderson et al. ..... 239/1
5,911,362 A * 6/1999 Wood et al. ..... 239/1

* cited by examiner

*Primary Examiner*—Thai-Ba Trieu
(74) *Attorney, Agent, or Firm*—Inskeep Intellectual Property Group, Inc.

(57) ABSTRACT

A fluid sprayer system using a modulated hydraulic control valve and a positive displacement pump to control the amount of fluid sprayed by the system. The modulated hydraulic control valve may be controlled using pulse width modulation and may be provided with a substantially constant source of hydraulic fluid. The pulse width modulated hydraulic control valve provides the hydraulic fluid to a hydraulic motor as a controlled flow. The controlled flow serves to control the hydraulic motor that controls a positive displacement pump. The position displacement pump is used to control the amount of fluid sprayed by the system. The control system changes the signal to the control valve so as to mitigate pressure changes otherwise caused by said positive displacement pump.

16 Claims, 9 Drawing Sheets

FLUID SPRAYER SYSTEM USING MODULATED CONTROL VALVE AND A POSITIVE DISPLACEMENT PUMP

CROSS REFERENCE TO RELATED APPLICATIONS

The present application claims priority to U.S. Provisional Patent Application No. 60/349,538, filed Jan. 16, 2002 and No. 60/377,472, filed May 3, 2002, whose contents are fully incorporated herein by reference.

BACKGROUND OF THE INVENTION

1. Field of the Invention

The invention relates to chemical sprayer systems. More particularly, the invention relates to chemical sprayer systems utilizing a hydraulically driven, electronically controlled pumping mechanism.

2. General Background and State of the Art

Commercial chemical sprayer systems are used for applying chemical solutions such as fertilizers and pesticides to a landscape, including, for example, a golf course or an agricultural planting field. Such systems typically are mounted on or incorporated into a vehicle chassis so that the user may efficiently and effectively deliver and distribute the chemical solution over a large amount of real estate.

In this regard, FIG. 1 shows a schematic of a typical prior art sprayer system. It includes a large tank that contains the chemical solution (usually formulated by a mixture of water and concentrated chemical) in fluid communication with a centrifugal pump. Downstream of the pump is a pressure control valve followed by a plurality of electric-solenoid operated on/off valves, each of which is associated with a boom that receives a plurality of nozzles. The booms are typically oriented on a vehicle such that the nozzles on each boom are positioned over the area of ground intended for receipt of the chemical solution. The system also includes lines (both from the pump and from the on/off valves) that direct fluid not otherwise exiting through the nozzles back into the tank.

In operation, a desired amount of chemical solution is manually poured into the tank by the user. Such tanks typically include an agitation pump (not shown) to ensure proper mixing of the chemical solution during this initial filling stage of operation. Once the desired amount of solution is present and mixed in the tank, and once the vehicle has arrived at the desired landscape target, the user will activate the pump. The pump will then draw fluid out of the tank and direct it through the pressure control valve to the on/off valves. Some of the fluid exiting the centrifugal pump is immediately returned to the tank to ensure that the chemical solution in the tank remains substantially homogeneous.

When the user desires to initiate delivery of the chemical solution to the target landscape, the user will activate one or more of the on/off valves so that the fluid is allowed to exit the nozzles situated on the boom (or booms) that have been selected. When the target landscape has been adequately sprayed with the chemical solution or the user, for whatever reason, decides to discontinue or change the fluid delivery scheme, the user will deactivate the appropriate on/off valve(s) and thereby prevent further fluid flow through the associated nozzles. Any pressure spikes that occur due to this change in the state of the on/off valves is mitigated (although not usually eliminated) by the pressure control valve. Finally, to the extent fluid flow to the on/off valve exceeds the amount actually exiting through the associated nozzles, the excess fluid bypasses the nozzles and is directed back into the tank. One example of a spray system that includes many of the concepts described above is the Multi Pro.RTM dedicated spray vehicle previously offered by The Toro Company.

Although prior art sprayer systems such as those described above have generally served to effectively meet the needs of users in the past, there have been lingering desires to improve and advance the way such fluid sprayer systems manage and deliver these fluids. The desire to do so has become more acute in recent times due to heightened sensitivity to environmental issues and to competitive economic pressures. For example, although centrifugal pumps are generally accepted in the industry, centrifugal pumps also have a reputation of needing regular and constant maintenance, particularly as to the integrity of the pump seals. As such, centrifugal pumps present both an economic and environmental challenge to users and purchasers of existing sprayer systems.

On the other hand, alternatives to centrifugal pumps present their own technical challenges. For example, one alternative to a centrifugal pump is a positive displacement pump (e.g., a diaphragm pump), a pump known to offer greater reliability than centrifugal pumps, particularly as to the pump seals. However, the flow and pressure characteristics of positive displacement pumps are such that changes in flow demand in the system create unacceptable conditions for other components of the sprayer system.

For example, when a user decides to activate or deactivate an on/off valve, the resulting change in flow demand leads the positive displacement pump to cause unacceptable pressure spikes in the system. Repeated encounters by the system with such pressure spikes eventually causes deterioration and damage to other parts of the system, including system seals, thus necessitating the very system maintenance and attention that it was hoped could be avoided through the use of such a diaphragm pump. Such pressure spikes can also lead ultimately to inaccurate application of the chemical solution to the target landscape.

OBJECTS AND SUMMARY OF THE INVENTION

In view of the foregoing, it is an object of the present invention to provide an improved sprayer system that addresses the aforementioned and other undesirable aspects of prior art sprayer systems.

It is a further object of the present invention to provide a sprayer system that has greater reliability and less maintenance demands than prior art sprayer systems.

If is a further object of the present invention to provide a sprayer system that mitigates or even eliminates pressure spikes in a system having an efficient pumping source.

It is a further object of the present invention to provide a sprayer system that controls a pump in such a manner that flow demands required by the user do not cause harmful effects on system components.

It is a further object of the present invention to provide a sprayer system that adjusts rapidly to changing flow demands in a manner that is unobtrusive to the user.

It is a further object of the present invention to provide a control system that more effectively and efficiently manages fluid flow of a sprayer system.

These and other objects not specifically enumerated here are addressed by the present invention which in at least one embodiment may include a spray system having a plurality of booms mounted on a base structure and a plurality of nozzles disposed on said booms. In this embodiment the system further includes a control system and a hydraulic control module having an electronically operated valve, wherein the valve is in electronic communication with the control system. Also included is a hydraulic motor in communication with the hydraulic control module, wherein operation of the hydraulic motor is controlled by the hydraulic control module. Finally, a positive displacement pump is linked to the hydraulic motor, wherein operation of the positive displacement pump is controlled by the hydraulic motor and wherein the positive displacement pump provides pressurized flow of a liquid solution to said booms. Then, a square wave signal is communicated from the control system to the electronically operated valve and the square wave signal is adjustable by said control system according to a change in the state of flow through said nozzles in at least one of said booms. Moreover, the square wave signal is adjustable so as to mitigate pressure changes in the spray system.

DESCRIPTION OF THE PREFERRED EMBODIMENTS

Figure 1:
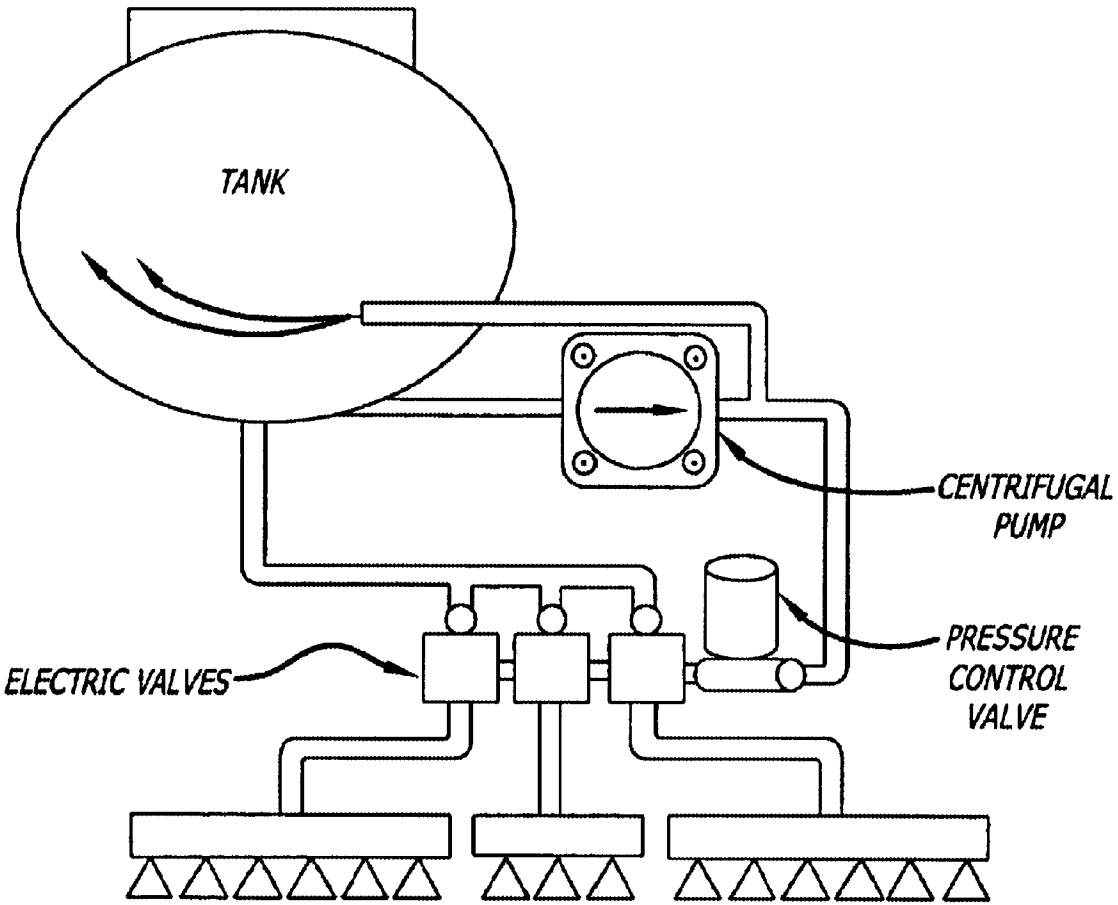
FIG. 1 (Prior Art)
FIG. 1 is a schematic rendering of a prior art spray system.
Figure 2:
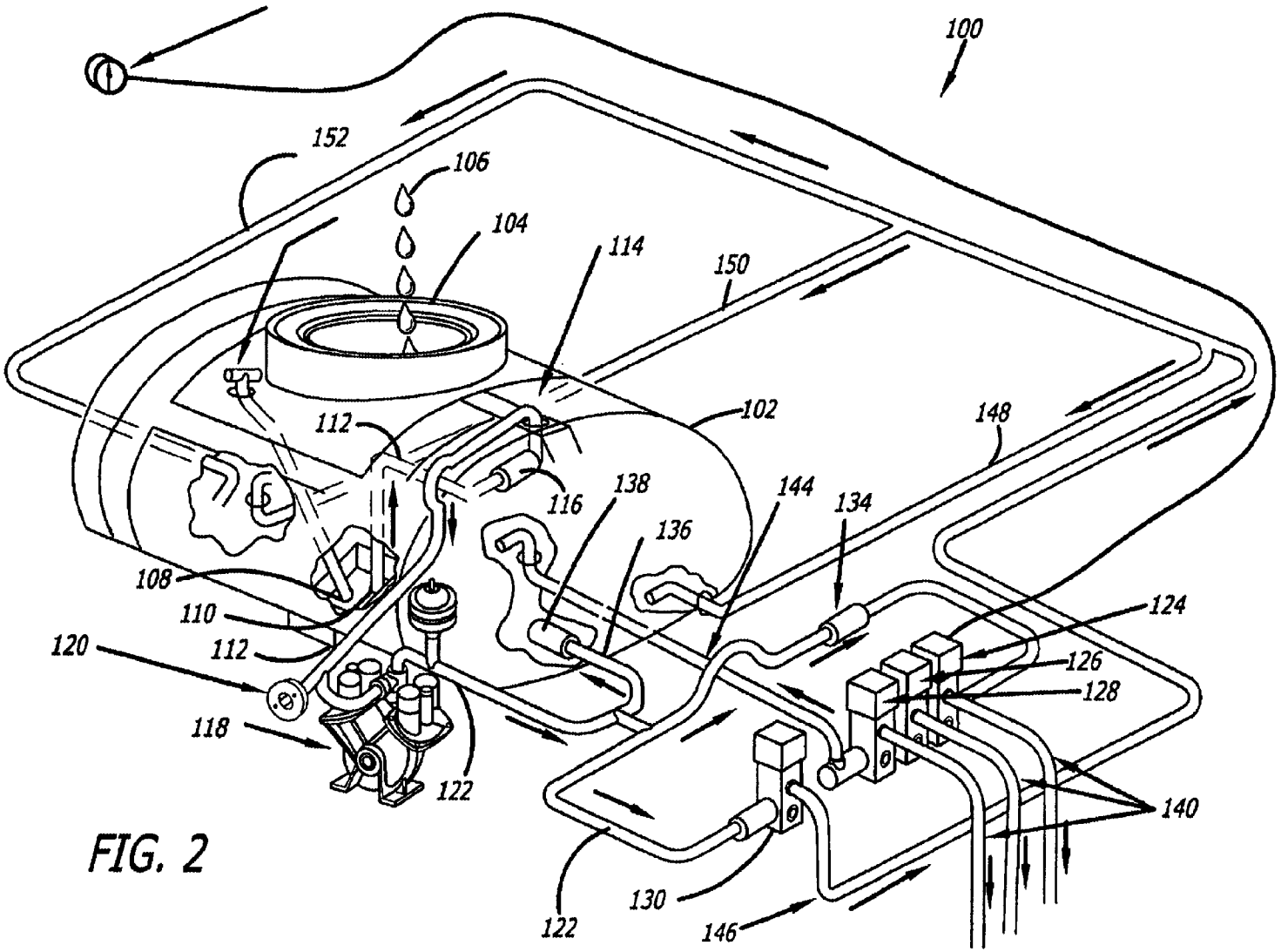
FIG. 2 is a chemical fluid flow schematic of one embodiment of a spray system in accordance with the present invention.

Referring to FIG. 2, a flow diagram of a spray system 100 in accordance with one embodiment of the present invention is disclosed as having a tank 102 for receiving, through its spout 104, a chemical solution 106. The chemical solution 106 is typically a mixed formulation of concentrated chemical and water wherein the chemical can be a fertilizer, a pesticide or any other substance that a user wishes to distribute over a particular landscape. In a preferred embodiment the tank 102 has a capacity of approximately 300 gallons.

Situated on the top of the tank 102 is a top mounted release lever that is linked to tank drain valve 108 located in and at the bottom of the tank 102. When the release lever is actuated, the drain valve will drain the solution 106 out of the bottom of the tank 102.

In close proximity to the drain valve 108 at the bottom of the tank 102 is a suction port 110 that is located at one end of a conduit 112 which extends from the suction port 110 through an opening 114 on the top of the tank 102 (including a screen (filter) 116) and terminates at the inlet of a positive displacement pump in the form of a diaphragm pump 118. The conduit 112 further includes a suction dampener 120 as an extension of the conduit 112 just prior to the connection with the inlet of the diaphragm pump 118. In one embodiment, the diaphragm pump is a pump manufactured by Hardi International A/S of Denmark and has a flow capacity of approximately 25 GPM.

Extending from an outlet of the diaphragm pump 118 is another conduit 122 that communicates the pump 118 both to an array of boom control valves 124, 126, 128 and to an agitation control valve 130, the conduit 122 including a flowmeter 134 immediately upstream of the control valves. Finally, the conduit 122 includes an extension 136 positioned upstream of both the boom control valves 124, 126, 128 and the agitation control valve 130 that leads to a pressure relief valve 138 located internal to the tank 102.

Continuing with reference to FIG. 2, there is a boom supply conduit 140 that extends from each of the three control valves 124, 126, and 128. In one embodiment, these valves are standard solenoid valves. These conduits extend from the valves to booms (not shown on this Fig.) which contain nozzles that distribute the chemical solution to the target landscape. Finally, immediately downstream of all three control valves 124, 126 and 128 is a boom bypass conduit 144 that extends from the valves to a location internal to the tank 102.

Extending from the agitation control valve 130 is an agitation line 146 which branches into three agitation feed lines 148, 150, 152, each of which terminates at a location internal to the tank 102. Preferably, the feed lines 148, 150, 152 terminate at a location near the internal bottom surface of the tank 102 so as to facilitate qualitative mixing of the chemical solution 106 as it is delivered to the tank 102 from the agitation control valve 130.

In operation, the user will initially fill the tank 102 with the desired chemical solution 106. The user will then start a motor (not shown) on the sprayer system which then energizes the diaphragm pump 118. This leads to the suction of the chemical solution through the suction port 110 up through the conduit 112 through the opening 114 of the tank 102 and to the inlet of the pump 118. This creates a pressure head at the outlet of the pump 118 and pressure loads the boom control valves 124, 126, 128 and the agitation control valve 130 through the conduit 122.

In one embodiment, the pressure generated by the pump will be in the range of 0 to 220 psi, with a preferred pressure being approximately 60 psi. To the extent pressure in the conduit 122 exceeds a predetermined maximum pressure, the pressure relief valve 138 located in extension 136 will be actuated so as to bleed chemical solution 106 back into the tank 102 and thereby reduce the pressure in the conduit 122.

Once the sprayer system has been located at a desired landscape site, the user typically then activates one or more of the boom control valves 124, 126, 128 in order to allow the pressure created by the diaphragm pump 118 to force a flow of chemical solution 106 to the nozzles located on the associated boom (not shown). The nozzles associated with the activated control valves 124, 126, 128 then direct the chemical solution 106 to the target landscape. During this time, a control system (described in greater detail below) monitors the flow rate of chemical solution 106 flowing through the boom control valves 124,126, 128 through the receipt of flow data from the flowmeter 134.

In a manual mode operation of the invention, flow otherwise being directed to one or more of the boom control valves 124, 126, 128 may somehow be forced to bypass those valves. In such an instance, the bypassing chemical solution 106 is directed back to the tank 102 through the boom bypass conduit 144. In an automatic mode of the invention, however, no such bypass is necessary since closure of the boom control valves will lead to the output of the diaphragm pump 118 being reduced to substantially zero. The automatic mode of the invention is discussed in greater detail below.

There are also situations wherein it is desired by the operator to cause agitation in the chemical solution 106 contained in the tank 102. Such agitation ensures that the chemical solution 106 maintains a substantially homogeneous state. In such situations, the user activates the agitation control valve 130 valve which allows the diaphragm pump 118 to urge the chemical solution 106 through the agitation control valve 130 into the agitation conduit and its downstream three agitation feed lines 148, 150, 152. This results in the chemical solution 106 being reintroduced to the bottom of the tank 102, thus causing the desired agitation of the fluid in the tank 102.

As noted in the Background of the Invention as set forth above, a positive displacement pump such as the diaphragm pump 118 depicted in FIG. 2 contains pressure and flow characteristics that may negatively impact the reliability and long term operation of other components of the system. In particular, such a pump may cause undesirable pressure spikes when the boom control valves 124,126,128 are activated into an on or an off position. As the present invention substantially eliminates these undesirable characteristics, it is instructive to describe the system that drives and controls the diaphragm pump 118. For this purpose, reference is made to FIG. 3.

Figure 3:
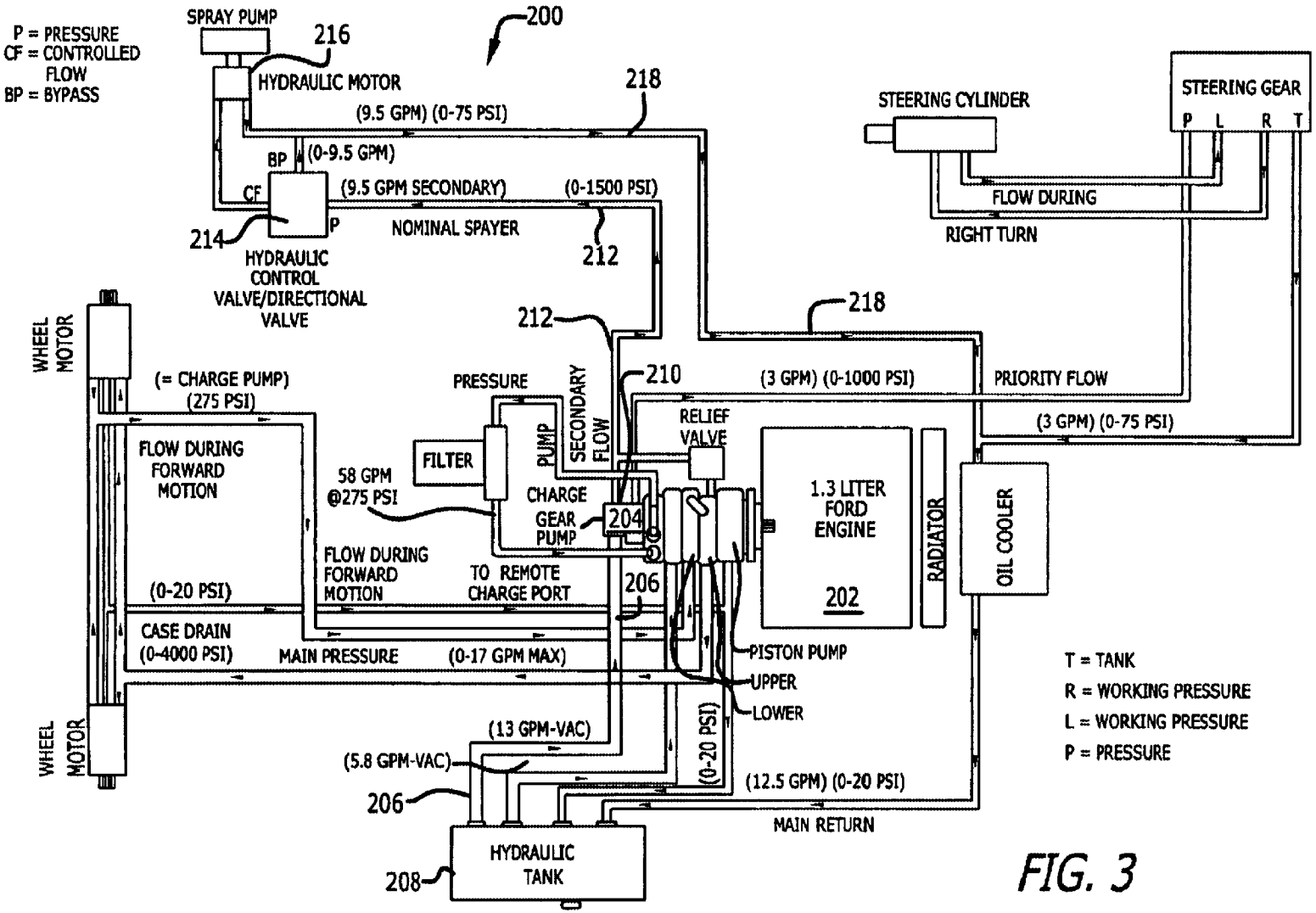
FIG. 3 is a hydraulic fluid flow schematic of one embodiment of a spray system in accordance with the present invention.

FIG. 3 depicts a hydraulic flow diagram for an embodiment of the present invention wherein the sprayer system is mounted on and integral with a vehicle. Although the system depicted in FIG. 3 includes detail of a number of different hydraulic systems on the vehicle, e.g., the hydraulic steering system, the hydraulic wheel drive system, etc., the focus of this discussion is on that portion of the system that operates the diaphragm pump 118.

In this regard, the hydraulic system 200 for the diaphragm pump 118 in this embodiment is driven by a 1.3 liter Ford engine 202 mounted on the vehicle wherein the power output of the motor 202 is connected to a gear pump 204. The inlet to the gear pump 204 is, through a fluid line 206, in fluid communication with a hydraulic fluid reservoir 208 such that when the gear pump 204 is in operation, hydraulic fluid is withdrawn from the reservoir 208 and pumped to an outlet 210 of the gear pump 204. Fluid exiting the outlet 210 is urged through a second fluid line 212 to a hydraulic control valve 214.

In a manner to be discussed below, the hydraulic control valve 214 dictates the amount, if any, of hydraulic fluid to be directed downstream to a hydraulic motor 216. In some instances, the hydraulic control valve causes all of the flow from the fluid line 212 to bypass the motor and simply directs the flow into a return line 218. In those instances where flow to the hydraulic motor 216 is permitted by the control valve, the hydraulic motor 216, which is connected to the diaphragm pump 118, then rotates to drive the input shaft of the diaphragm pump 118. The rotation of the shaft of the diaphragm pump 118 then obviously leads to pumping of the chemical solution 106 as discussed previously with reference to FIG. 2.

In a preferred embodiment, the gear pump 204 generates a flow of hydraulic fluid in the fluid line 206 from the reservoir 208 of approximately thirteen GPM. In the same embodiment, the flow in the fluid line 212 is approximately 9.5 GPM.

From this discussion of the hydraulic control system of FIG. 3, it will become evident that the speed and control of the diaphragm pump is dictated largely by the state of the hydraulic control valve 214. Hence, a further understanding of this valve and its operation is helpful to further understanding the present invention. For this purpose, attention is directed to FIG. 4.

Figure 4:
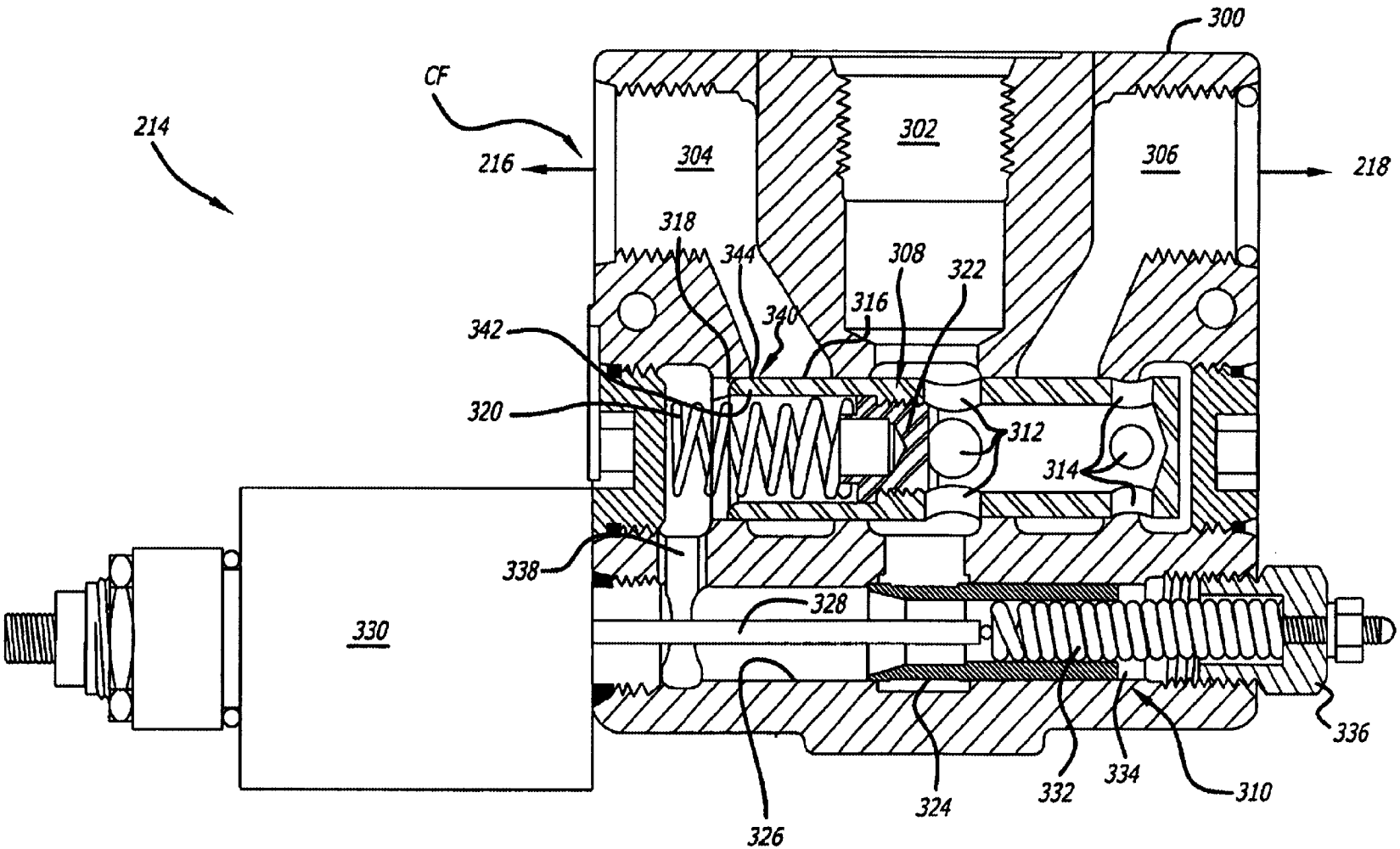
FIG. 4 is cross-sectional view of a hydraulic control valve for a spray system in accordance with the present invention.

FIG. 4 depicts a cross-sectional view of an embodiment of the hydraulic control valve 214 in a static, non-operating state. The valve 214 contains a housing 300 that has an inlet 302 and two outlets, the outlets being referred to as a controlled flow outlet 304 and a bypass outlet 306. Internal to the housing are disposed a pressure compensation spool 308 and a flow control spool 310.

The pressure compensation spool 308 has a plurality of inlet apertures 312 and a plurality of bypass apertures 314 and contains a metering portion 316 sized to fit and interact with metering bore 318 disposed in the housing 300. A pressure compensation spool spring 320 is positioned between the housing 300 and a threaded stub 322 fixed in the pressure compensation spool 308 so as to bias the pressure compensation spool 308 into the position depicted in FIG. 4.

The flow control spool 310 contains spool portion 324 that is slidably received in a control bore 326 of the housing 300. The control spool portion 324 is in contact with a shaft 328 of a solenoid 330 that is itself attached to the housing 300 at one end of the control bore 326. Received internally of the control spool portion 324 is a control spool spring 332 that extends from the control spool portion 324 to a receptacle 334 within a plug 336 that is threaded into an opposite end of the control bore 326 of the housing 300. The control spool spring 332 biases the control spool portion 324 into the position depicted in FIG. 4. Finally, the control bore 326 is in fluid communication with the metering bore 318 of the pressure compensation spool 308 via a passage 338.

During operation, the control valve 214 will receive at its inlet 302 a flow of hydraulic fluid from the gear pump 204 through the fluid line 212. The hydraulic fluid will travel through the inlet 302 towards the pressure compensation spool 308 and enter the internal areas of the spool 308 through the inlet apertures 312. If the solenoid 330 of the valve 214 remains unenergized, the control spool portion 324 will be oriented in the position as shown in FIG. 4 where flow is prevented from escaping out of the pressure compensation spool 308 into the control bore 326.

As a result, pressure will build up within the pressure compensation spool 308 to a point where the bias of the pressure compensation spool spring 320 is overcome and the pressure compensation spool 308 will move to the left. Movement to the left shall continue until the bypass apertures 314 are positioned so as to allow fluid internal to the pressure compensation spool 308 to escape into the bypass outlet 306 and thereby relieve the pressure that is otherwise causing the pressure compensation spool 308 to move to the left. In this mode of operation, no hydraulic fluid is reaching the hydraulic motor 216 (it all being bypassed into the return line 218) and thus the diaphragm pump 118 is not being driven.

If, on the other hand, the solenoid 330 of the valve 214 is energized (to be discussed in greater detail below) at the time hydraulic fluid reaches the inlet 302, the shaft 328 will have moved against the control spool spring 332 a certain amount to the right as determined by control of the solenoid 330. This movement shall cause the edge of the control spool portion 324 to move sufficiently to the right so as to allow a fluid path to exist between the internal region of the pressure compensation spool 308 and the control bore 326. The hydraulic fluid will then travel through the control bore 326 up into the passage 338 into the metering bore 318 of the pressure compensation spool 308.

From the metering bore 318 the hydraulic fluid will flow between a clearance 340 that exists between a metering edge 342 of the pressure compensation spool 308 and a corresponding lip 344 of the metering bore. The hydraulic fluid will then exit the valve through the controlled flow outlet 304 and travel to the hydraulic motor 216. This flow will cause rotation of the hydraulic motor 216 which, in turn, shall cause rotation of the input shaft of the diaphragm pump 118 (thus resulting in pumping of the chemical solution 106).

In a preferred embodiment, the hydraulic control valve 214 is operated with pulse width modulation which enables the solenoid 330 to move the control spool portion 324 (through movement of the shaft 328) rapidly and precisely so as to quickly and accurately arrive at a desired flow output. As will be discussed in greater detail below, such rapid and precise control gives the hydraulic control valve 214 the ability to compensate for some of the undesirable pressure and flow characteristics of the diaphragm pump 118.

During operation of the hydraulic control valve 214, a pulse width modulated (PWM) signal is applied to the valve coil (not shown) of the solenoid 330. The resulting pulsed current that flows through the valve coil creates a magnetic field within the windings such that the shaft 328 and, in turn, the control spool portion 324, is shifted in a pulsed or oscillating manner.

To create the PWM, an output transistor is typically used as an on/off switch that feeds the solenoid coil with a series of on/off pulses at a constant voltage. These pulses are typically set to a constant frequency within a range of 400 to 5000+ Hz. In a preferred embodiment, the frequency of the PWM signal is 120 Hz.

By varying the duration of the "on" (e.g., short) pulses relative to the "off" (e.g., long) pulses of the PWM signal, the on/off time of the valve 214 is regulated. More particularly, by varying the "on" and "off" pulses of the PWM signal, oscillating movement of the control spool portion 324 is created and regulated. Such oscillating movement will periodically open and close the spool portion 324 relative to the pressure compensation spool 308 and thereby periodically (according to the frequency of the pulses) allow fluid to pass from the pressure compensation spool 308 into the control bore 326 and from there to the hydraulic motor 216.

By increasing the duration of the "on" (e.g., short) pulses relative to the "off" (e.g., long) pulses, the control spool portion 324 will be in the open position for a greater length of time during each frequency period thereby allowing greater flow of hydraulic fluid to the hydraulic motor 216. Conversely, by decreasing the duration of the "on" (e.g., short) pulses relative to the "off" (e.g., long) pulses, the control spool portion 324 will be in the closed position (FIG. 4) for a greater length of time during each frequency period thereby reducing the flow of hydraulic fluid to the hydraulic motor. From this it can be seen that changes in duration of the "on" and "off" signals of the PWM signal will regulate the speed of the hydraulic motor 216 and thereby the speed of the diaphragm pump 118. Moreover, since the "on" and "off" pulses are being conveyed to the solenoid so rapidly (e.g., at a frequency of 120 Hz) the valve can respond very quickly and very precisely to demands for changes in the flow of hydraulic fluid. In other words, a PWM valve of this type has far greater performance characteristics (i.e., faster, more precise, etc.) than a standard solenoid valve. In this regard, in a preferred embodiment, the hydraulic control valve 214 is a PWM valve offered by Brand Hydraulics of Omaha, Nebr.

Having now discussed the operation of the hydraulic control valve 214 in a generic sense, it is useful to provide a more detailed discussion of how the hydraulic control valve 214 is controlled for use in the sprayer system of the present invention. For this purpose, attention is directed to FIGS. 5–11.

Figure 5:
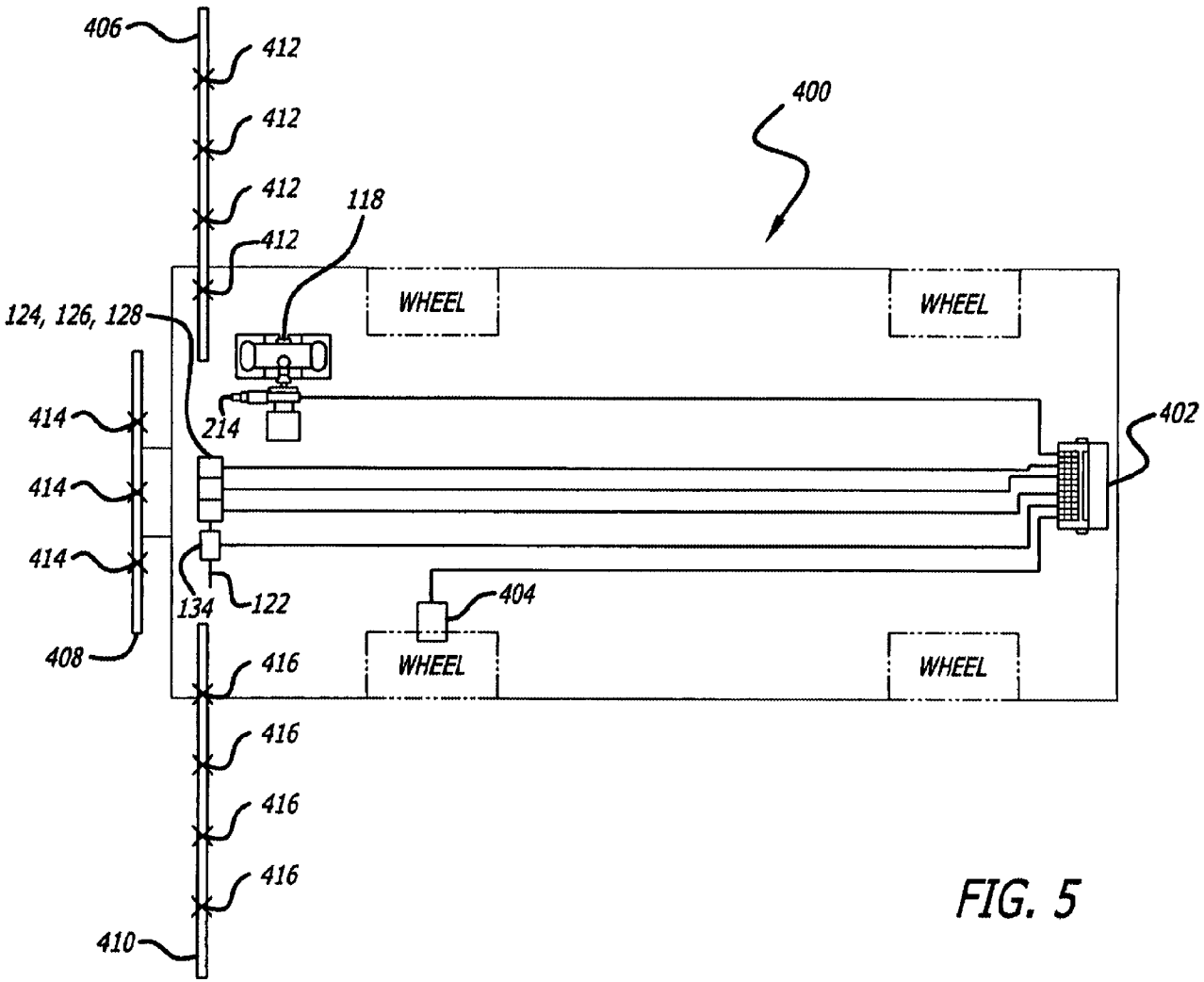
FIG. 5 is an electrical schematic of one embodiment of a control system for a spray system in accordance with an embodiment of the present invention.

FIG. 5 schematically shows a control system 400 for an embodiment of the sprayer system of the present invention that is mounted on and integral with a vehicle. The control system 400 includes a microprocessor 402 which is in electronic communication with each of the three boom control valves 124, 126, 128, it being recalled that these valves are, in this embodiment, standard solenoid valves. The microprocessor is also in electronic communication with the flowmeter 134 and a speed sensor 404, the former of which produces a signal indicative of the volume of chemical solution 106 flowing to the boom control valves 124, 126, 128 and latter of which produces a signal indicative of the speed at which the vehicle is traveling. Finally, the microprocessor is in electronic communication with the hydraulic control valve 214, which, as discussed above for this embodiment, is a PWM valve.

For the sake of completeness, FIG. 5 also includes a schematic rendering of booms 406, 408, 410 which correspond to each of the boom control valves, 124, 126, 128, respectively. Each of these booms 406, 408, 410 include a plurality of flow nozzles 412, 414, 416, respectively. In a preferred embodiment, there are four nozzles 412 disposed on the left boom 406, three nozzles 414 disposed on the center boom 408 and four nozzles 416 disposed on the right boom 410, for a total of eleven nozzles.

In one embodiment of the present invention, the control system 400 is configured such that fluid flow in the flowmeter 134 (FIG. 2) leading to the boom control valves 124, 126, 128 is monitored by the microprocessor 402 through a fluid flow signal. Depending on the status of the boom control valves 124, 126, 128 and the magnitude of flow measured in the conduit 122, the microprocessor changes the PWM signal to the valve 214 which thereby changes the speed of the hydraulic motor 216, which thereby changes and controls the speed of the diaphragm pump 118.

For example, if the microprocessor 404 senses that a boom control valve has been opened and that the fluid flow in the conduit 122 (through the flowmeter) is below a predetermined value for the number of boom control valves that are open, then the microprocessor determines that increased flow of the chemical solution 106 to the boom nozzles will be required. Consequently, the microprocessor 404 will adjust the PWM signal to the valve 214 such that more hydraulic fluid will be delivered to the hydraulic motor 204. The increased flow of hydraulic fluid will cause the hydraulic motor 216 to increase in speed, which, in turn will drive the diaphragm pump 118 faster, thus resulting in increased chemical solution 106 flow to the boom nozzles.

Similarly, if the microprocessor 402 senses that a boom control valve has been closed and that the amount of fluid flow in the conduit 122 (through the flowmeter) is greater than a predetermined value associated with the closure of that control valve, then the microprocessor determines that reduced flow of chemical solution 106 to the boom nozzles is required. Consequently, the microprocessor 404 will adjust the PWM signal to the valve 214 such that less hydraulic fluid will be delivered to the hydraulic motor 216. The decreased flow of hydraulic fluid will cause a decrease in hydraulic motor speed, which will lead to a reduced speed of the diaphragm pump 118, thus resulting in a decrease flow of chemical solution 106 in the conduit 122.

With the use of a control valve 214 driven with a PWM signal by the microprocessor 402 in this manner, the pressure spikes that may otherwise be caused by the use of a diaphragm pump 118 are mitigated. This results from the rapid response time that can be achieved using such a PWM control valve.

Figure 6:
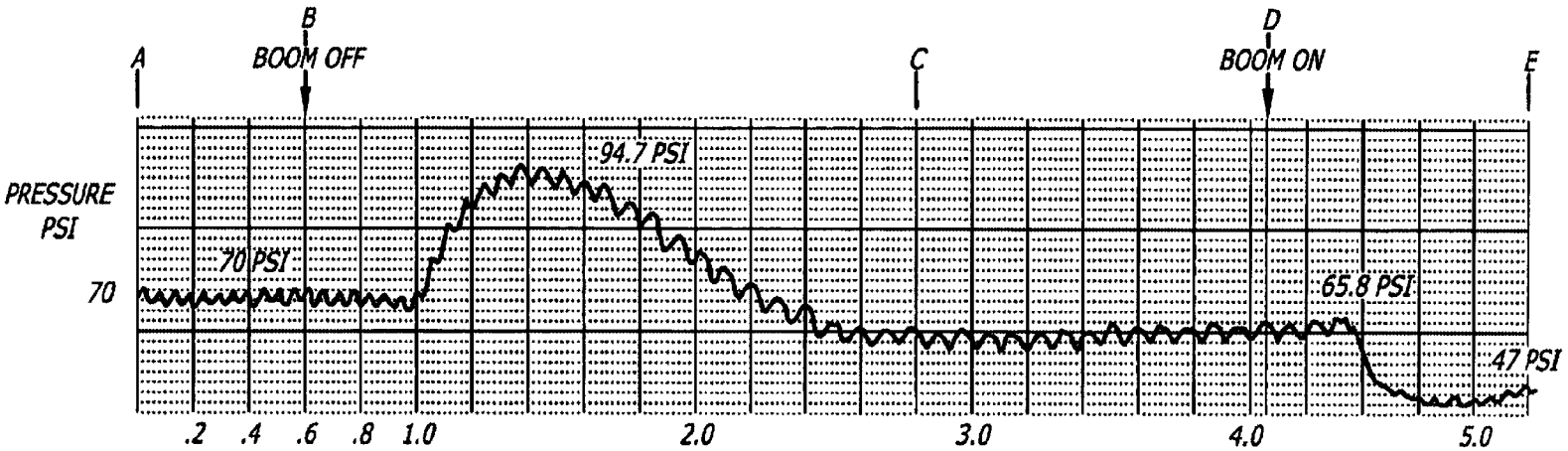
FIG. 6 is a graph of a pressure curve in one embodiment of a spray system in accordance with the present invention.

In this regard, FIG. 6 depicts an example of what the pressure profile within the conduit 122 looks like when the sprayer system is controlled according to the immediately preceding discussion. More particularly, FIG. 6 is a graphical representation of the pressure in the conduit 122 between the diaphragm pump 118 and the boom control valves 124,126, 128 measured during a number of different flow conditions on a prototype sprayer system controlled as described above.

The first period, defined by points A and B, depicts the pressure in the conduit 122 when one of three boom control valves 124 has been energized and chemical solution 106 is flowing through the conduit 122 and exiting through the nozzles (e.g., 412 in FIG. 5) on one of the boom sections (e.g., 406 in FIG. 5). The second period, defined by points B and C in FIG. 6, depicts the pressure in the conduit 122 immediately after the boom control valve 124 has been de-energized. Finally, the third period, defined by points D and E in FIG. 6, depicts the pressure in the conduit 122 at the time immediately after the boom control valve 124 has been re-energized.

As is evident from the embodiment depicted in FIG. 6, the pressure in the conduit 122 during the first period (i.e., during constant flow through the valve 124) was 70 psi. Then when the second period started (i.e., when the valve 124 was shut off), the pressure remained at essentially 70 psi. for a period of approximately 0.4 seconds and then increased to a maximum of about 94.7 psi until returning to approximately 70 psi over the next 1.8 seconds. Finally, when the third period started (i.e., when the valve 124 was turned back on), the pressure again remained at essentially 70 psi. for approximately 0.39 seconds before decreasing to a low of 47 psi until returning to approximately 70 psi over the next 1.6 seconds.

The pressure variations associated with turning the boom control valves 124, 126, 128 on and off can be further mitigated through an alternative embodiment of the control system of present invention. In this embodiment, the control system 400 incorporates a microprocessor 402 that senses three parameters of the system, namely, the ground speed of the vehicle via the speed sensor 404, the flow through the conduit 122 via the flow meter 122 and the state of each of the boom control valves 124, 126, 128. By monitoring each of these parameters of the system, the microprocessor arrives, through a programmed routine, at the appropriate PWM signal to actuate the hydraulic control valve and thereby control the speed of the diaphragm pump 118.

The microprocessor 402 of the control system 400 includes a programmed chemical solution 106 flow rate schedule (as measured by the flowmeter 122) that should result from inputs of a given vehicle speed and a given boom control valve on/off configuration. The microprocessor 402 varies the PWM signal to the degree necessary for the diaphragm pump 118 (as driven by hydraulic motor 204) to achieve the scheduled flow rate for the given input parameters. For example, the microprocessor 402 is programmed to generate a particular flow rate in response to a vehicle speed of, say, 5 mph and a boom control valve 124, 126, 128 configuration where all three control valves are energized (i.e., all three valves are "on") thus allowing flow of the chemical solution 106 to all three booms. The microprocessor 402 will generate a PWM signal to drive the control valve 214 that results in the diaphragm pump 118 being driven at a speed to provide the particular desired flow rate.

In normal operation, the microprocessor 402 will operate in a closed loop mode as set forth above. However, the microprocessor 402 further includes a subroutine that will operate in an open loop manner for a short period of time so as to mitigate pressure variations in the system due to changes in the state of the boom control valves 124, 126, 128 during normal operation. The operation of this subroutine operates is set forth below.

When the microprocessor senses that the state of a boom control valve 124, 126, 128 has changed, the subroutine will have sampled the current flow rate as being measured by the flow meter 134. The subroutine will further sense what specific change is taking place in the state of the boom control valves 124, 126, 128. That is, the subroutine will sense whether one or more booms are being turned on or turned off. If, for example, a boom is being turned off, this means that an increase in pressure in the conduit 122 will shortly follow. Accordingly, the subroutine will adjust the PWM signal such that the output of the diaphragm pump (through control of the speed of the hydraulic motor 204) is reduced in at least the amount equal to the reduction in flow that will imminently result from a boom being shut off. Moreover, this change in the PWM signal is initiated immediately upon sensing the change in state of one or more of the boom control valves 124, 126, 128.

By way of further example, assume that a vehicle is equipped with three boom sections 406, 408, 410 having nozzles 412, 414 and 416 being mounted on each boom in a four nozzle, three nozzle, four nozzle configuration, respectively (FIG. 5). Further assume that the microprocessor is sensing a constant vehicle speed of 5 mph from the sensor 404 and a chemical fluid 106 flow rate of 11 gpm from the flow meter 134 with all three boom control valves 124, 126, 128 being energized (i.e., they are all "on"). This means that there are a total of eleven nozzles through which the chemical fluid 106 is flowing.

Then, further assume that the operator has turned off the boom control valve 124 associated with the left boom 406. The subroutine in the microprocessor 402 will sense this change and then immediately adjust the PWM signal being sent to the hydraulic control valve 214 so that the diaphragm pump 118 reduces its output by the volume that would otherwise be expected to flow out of the nozzles on the left boom 406. In this case, that is a 4/11's reduction in the flow rate that was sensed in the flow meter 134 immediately prior to the operator turning the left boom off (assuming vehicle speed has remained constant). This serves to anticipate a pressure increase that otherwise will be encountered by the system.

The subroutine operates in a similar manner in a situation where a boom control valve 124, 126, 128 is being turned on. That is, when the subroutine senses that the operator has turned on, say, the right boom 410, the subroutine will act to adjust the PWM signal to the control valve 214 such that the flow rate coming from the diaphragm pump will increase by 4/7ths over what was sensed by the flow meter 134 immediately prior to the boom control valve 128 being energized. This serves to anticipate a pressure decrease that otherwise will be encountered by the system and compensate by immediately increasing the flow of the chemical solution 106 to the boom control valves 124, 126, 128.

Once the subroutine has been executed as described above, the program returns to its main routine. In that main routine, the flow, vehicle speed and nozzle states are all monitored and the flow controlled in the aforesaid closed loop fashion.

By virtue of the rapid response offered by the microprocessor and a PWM control valve controlled in accordance with this embodiment, changes in system pressure can be largely anticipated and accounted for well before the pressure changes actually occur. As a result, the pressure fluctuations otherwise encountered by using a diaphragm pump are further mitigated if not eliminated altogether. In this regard, reference is made to FIG. 7 which depicts a pressure curve within the conduit 122 of the system using a control system as just described.

Figure 7:
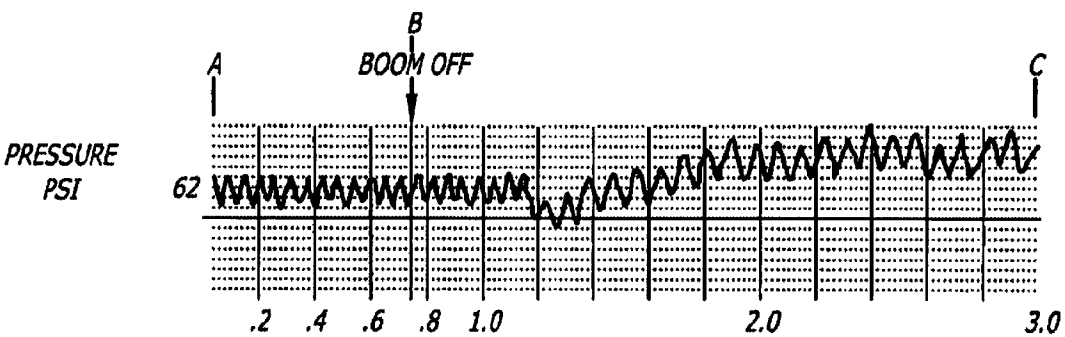
FIG. 7. is a graph of a pressure curve in another embodiment of a spray system in accordance with the present invention.

For the first period of the curve set forth in FIG. 7, defined by points A and B, there is one boom that is on and the pressure in the conduit 122 measured through a pressure sensing line is approximately 62 psi. In the second period, defined by points B and C, the boom has been shut off which results in a the system pressure remaining substantially constant at 62 psi for a period of approximately 0.4 seconds followed by a mild, almost immeasurable, pressure decrease for a period of approximately 0.2 seconds after which the pressure returns to approximately 62 psi.

It can be seen that the response offered by the control system of the above-described embodiment so rapidly accounts for the anticipated pressure increase in the system that there is actually a slight pressure decrease in the system at the time shortly after the boom is shut off. Hence, it can be seen that the control system effectively mitigates the undesirable pressure and flow characteristics of the diaphragm pump.

In another aspect of the previously described control system, the degree to which the PWM signal is adjusted in response to the changing state of a boom control valve is determined according to the relationship between a signal value, e.g., an "offset," generated by the microprocessor 402 (and followed by the control valve 214) and the flow through the flow meter 134 for a given collection of nozzles 406, 408, 410 on the booms. In this regard, in one embodiment of the invention related to sprayer systems used in turf applications (e.g., golf courses), there are typically four sets of nozzles available to a standard user. These sets are differentiated by flow capacity (i.e., flow apertures) and are each assigned a corresponding color, namely, yellow, red, blue and green.

The yellow nozzles have the smallest flow capacity with a range of flow being approximately 1.0 to 4.5 gpm. The red nozzles are next, with a range being approximately 2.0 to 8.0 gpm, followed by the blue nozzles, which have a range of approximately 5.0 to 17.0 gpm. Finally, the green nozzles have the largest flow capacity with a range of flow being approximately 7.0 to 21.0 gpm. In most embodiments, the same set of nozzles will be used on all three of the booms. That is, in most if not all embodiments, there will be no mixed use of nozzle sets across the booms. Thus all the booms will have, for example, the red nozzles or all the booms will the blue nozzles and there will not be a configuration where red nozzles are on the left boom and blue nozzles are on the right boom.

In order for the microprocessor 402 to generate the appropriate adjustment to the PWM signal in response to a change in state of a boom control valve (as discussed previously), it is necessary for the microprocessor 402 to know what the PWM offset should be for each of the flow rates of each set of nozzles. For example, at a flow rate of 5.0 gpm using yellow nozzles wherein all three booms 406, 408, 410 are in use (i.e., all eleven yellow nozzles are dispersing the chemical solution 106), the microprocessor 402 must have present in its memory the PWM signal offset that will be required in order to reduce the 5.0 gpm flow rate by 4/11ths (i.e., to reduce it to 3.2 gpm) at the time the microprocessor 402 senses that one of the booms has been shut off.

In this regard, reference is made to FIGS. 8–11 wherein the PWM signal offset value is shown relative to the flow rates of yellow, red, blue and green nozzles, respectively. These offset values were determined by actual testing wherein the PWM signal offset being sent to the control valve 214 for a particular flow rate was demonstrated and recorded.

Figure 8:
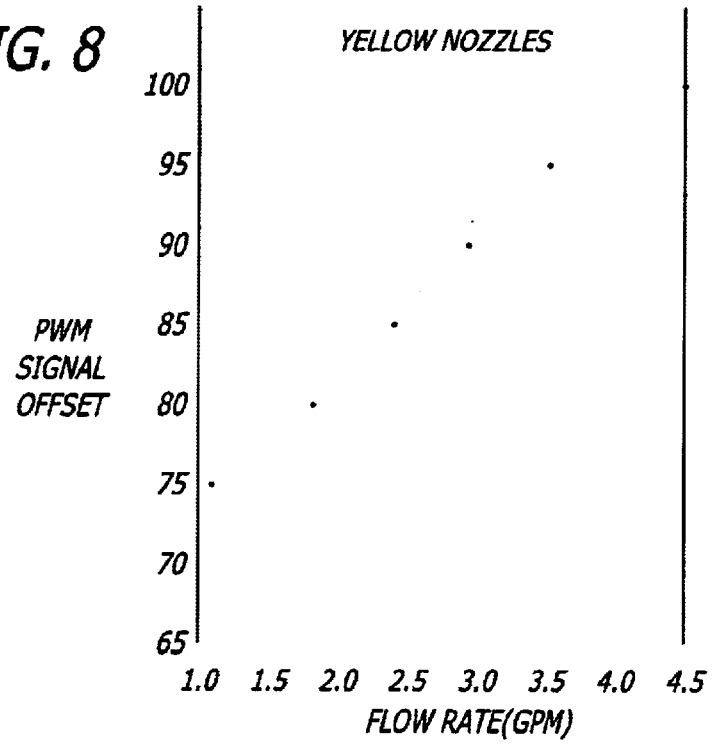
FIG. 8 is a graph relating pulse width modulated offset versus flow rate in one embodiment of a spray system in accordance with the present invention.
Figure 9:
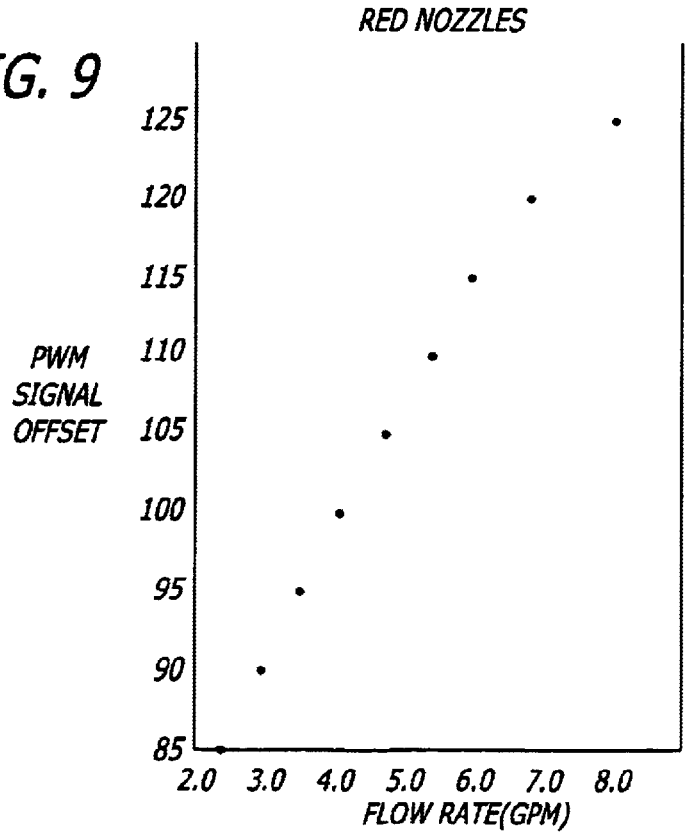
FIG. 9 is a graph relating pulse width modulated offset versus flow rate in one embodiment of a spray system in accordance with the present invention.
Figure 10:
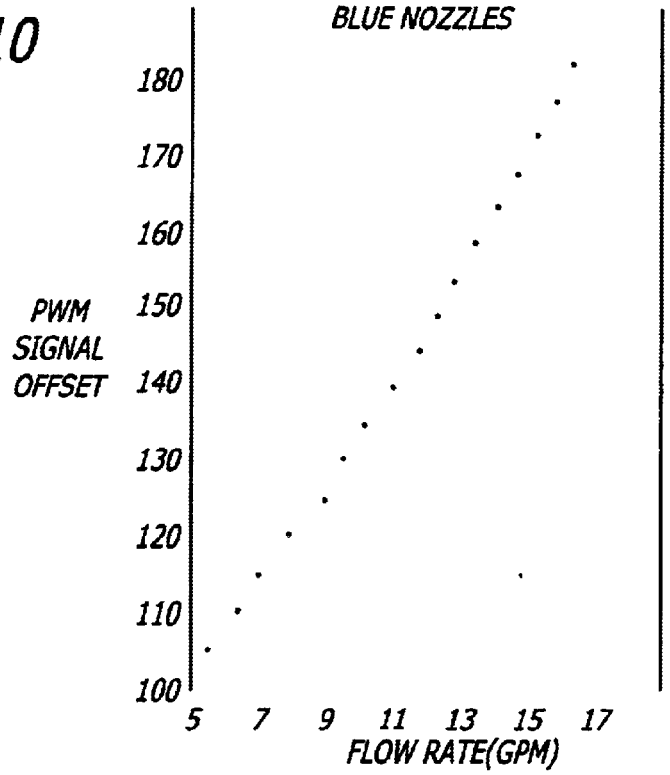
FIG. 10 is a graph relating pulse width modulated offset versus flow rate in one embodiment of a spray system in accordance with the present invention.
Figure 11:
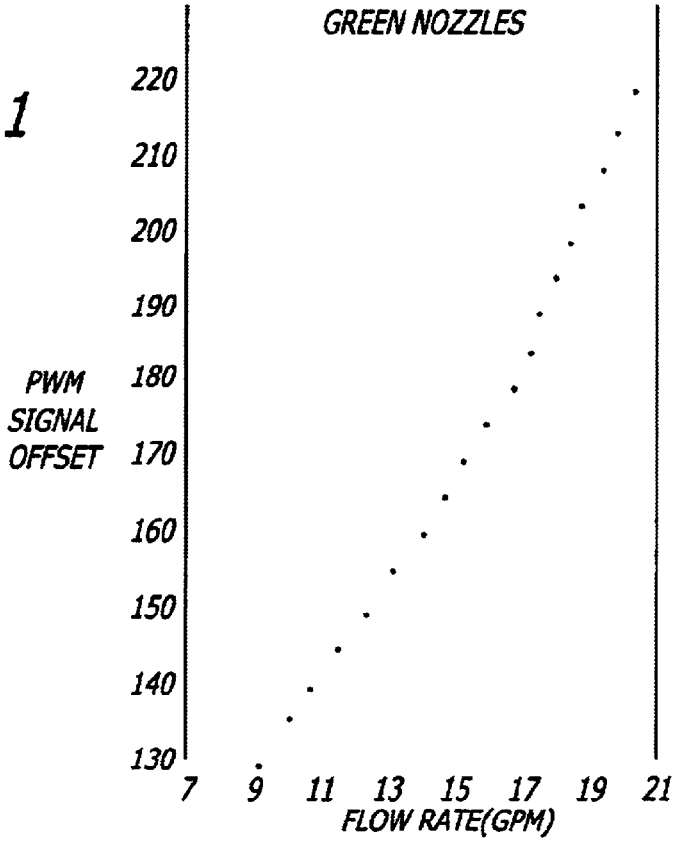
FIG. 11 is a graph relating pulse width modulated offset versus flow rate in one embodiment of a spray system in accordance with the present invention; and, FIGS. 12A and 12B are graphs depicting a pulse width modulated signal used in an embodiment of a spray system in accordance with the present invention.

As is evident from FIGS. 8–11, the relationship between PWM offset and flow rate for each set of nozzles is a substantially linear one. Moreover, the offset values do not differ significantly for flow rates that overlap with multiple nozzle sets. For example, the PWM offset value for 4.5 gpm using yellow nozzles is approximately 100 (FIG. 8). For the same flow rate of 4.5 gpm using red nozzles, the PWM offset value is approximately 105 (FIG. 9) As a result, in at least one embodiment, the microprocessor 402 can use a single schedule of offset values for all nozzle sets. Of course, in another embodiment, the microprocessor can be programmed to have a different schedule of offset values for each nozzle set.

In summary, it is further understood how the controller 400 controls the control valve 214 using PWM to further mitigate the pressure fluctuations encountered by use of the diaphragm pump 118. For example, assume that the vehicle carrying the sprayer system is moving at a constant speed of 5 mph (as measured by the speed sensor 404) with all three booms being "on." Further assume that the nozzles on the booms are blue nozzles and the flow throw the booms (as sensed by the microprocessor through the flow meter 134) is 11 gpm. This means that the microprocessor 402 is sending a PWM offset signal of approximately 140 to the control valve 214 (See FIG. 10) so that the diaphragm pump 118 is being driven (via the hydraulic motor 216) at a level to maintain the 11 gpm.

Now assume that the operator turns the left boom off. The control system 400 will then know that the 11 gpm flow will soon be reduced by 4/11ths to 7 gpm. The microprocessor 402 determines that the PWM offset value that corresponds to 7 gpm for blue nozzles is approximately 112 (FIG. 10) and thus reduces the PWM signal accordingly. Alternatively, the microprocessor 402 simply reduces the of PWM offset value by 4/11ths. Moreover, the microprocessor 402 makes this change in the PWM signal (via the subroutine discussed above) within the approximately 0.4 seconds (See FIG. 6) that it takes the boom control valve 124 to change its state in response to the operator turning off the valve. Hence, the pressure change that would otherwise be encountered by the system is anticipated and avoided.

Figure 12A:
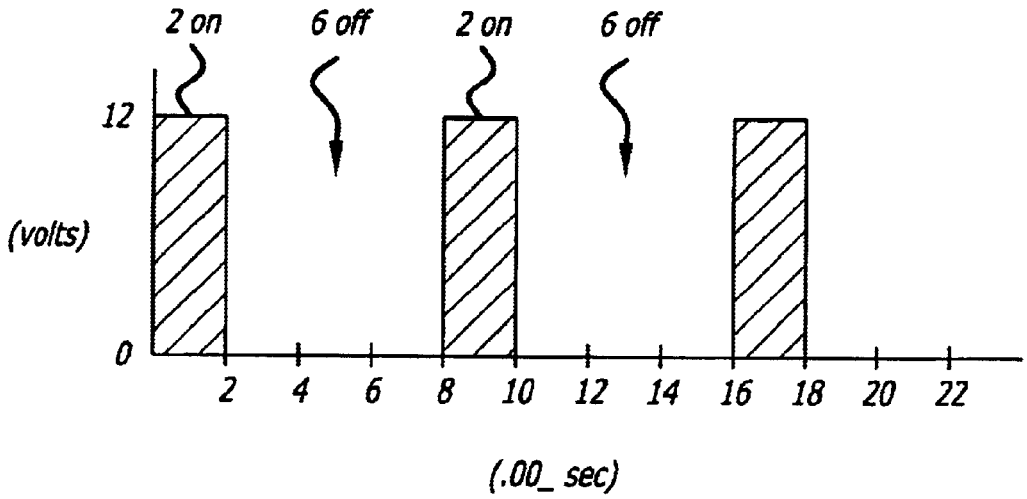
Figure 12B:
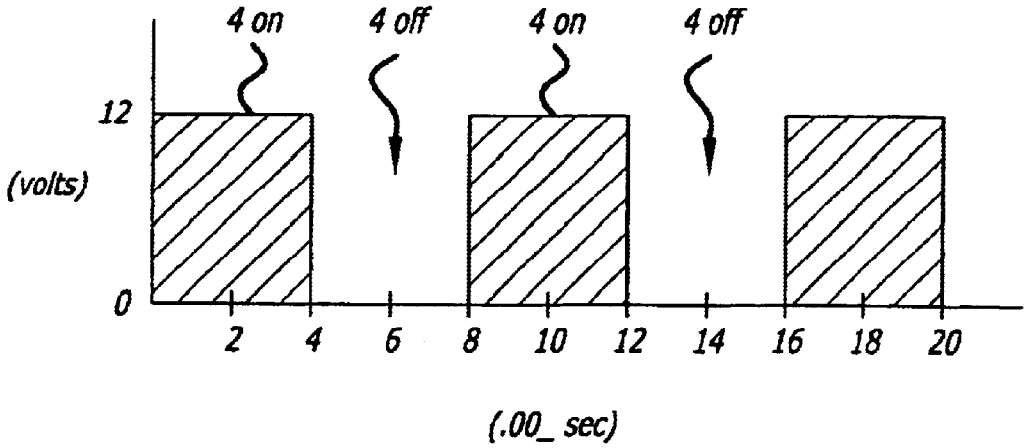

In a preferred embodiment of the present invention, the PWM signal is a pulsed, square wave, electrical signal ranging between approximately 0 to 12 volts at a frequency of approximately 122 Hertz. By way of example, when the control valve 214 is in a closed state, there is no signal being sent to it. Further, as depicted in FIG. 12A, when the control valve is 25% open, the controller sends a continuing series of pulses comprising an "on" 12 volt pulse for 0.002 seconds, no signal (or an "off" signal) for 0.006 seconds, another "on" 12 volt pulse for 0.002 seconds, etc. for as long as the control valve 214 is maintained in the 25% open state. Further, as depicted in FIG. 12B, when the control valve is 50% open, the controller sends a continuing series of pulses comprising an "on" 12 volt pulse for 0.004 seconds, no ("off") signal for 0.004 seconds, another "on" 12 volt pulse for 0.004 seconds, etc. for as long as the control valve 214 is maintained in the 50% open state. The ratio between the "on" and "off" portions of the signal can be deemed the PWM offset.

In another embodiment of the present invention, the control system 400 includes an additional subroutine to enhance the safe operation of the sprayer system. This subroutine senses the vehicle speed (through the speed sensor 404) and the status of the boom control valves 124, 126, 128. If during an "on" state of one of the boom control valves, the subroutine at any time senses that the vehicle speed is zero, the subroutine will automatically reduce the PWM offset value to zero, thus resulting in the output of the diaphragm pump 118 also being reduced to zero. The reason for this subroutine is to avoid continual deposition of the chemical solution 106 to the target landscape when the vehicle has come to a stop. A system without this safety will lead to excessive deposition of the chemical solution 106, which not only raises environmental concerns but also likely injures the target landscape. This safety may be referred to as an "emergency stop" safety.

In another embodiment, the sprayer system is mounted on a vehicle wherein the microprocessor 402 is located on a control panel located in a cab or operator section of the vehicle. This embodiment may further include three lighted remote boom switches and one lighted remote agitation switch.

In yet another embodiment, the control system 400 includes an agitation switch which, if turned on, will result in energizing of the agitation control valve 130 (FIG. 2). Moreover, the control system 400 includes a subroutine wherein, if the agitation switch has been turned on either before or during flow being provided through the booms, and, the booms are then turned off, then the subroutine immediately changes the PWM signal to a predetermined minimum sufficient to cause the diaphragm pump 118 to provide an agitation flow of the chemical solution 106. The predetermined minimum offset of the PWM signal may be set by the operator on the control system 400 prior to turning the booms on.

In one final embodiment, the combined data that operates to provide the protocol for controlling the system, including the data for controlling the hydraulic control valve 214, the hydraulic motor 210, the diaphragm pump 118, the boom control valves 124, 126, 128, the speed sensor 404, the flow meter 134, the pressure line 100 and other components previously mentioned, can be included as non-volatile memory in a controller chip and used in a master controller for the system. In a preferred embodiment, such a controller chip is provided by Raven Industries, Inc.

Finally, the present invention has widespread applications. It may be used in virtually any application where controlled delivery of fluid, with or without a vehicle, is desired. This includes turf applications and agricultural applications A preferred embodiment of the invention is described above. Those skilled in the art will recognize that many embodiments are possible within the scope of the invention. Variations and modifications of the various parts and assemblies can certainly be made and still fall within the scope of the invention. Thus, the invention is limited only by the following claims and equivalents thereof.

What is claimed is:

1. A spray system, comprising:

a plurality of booms mounted on a base structure;

a plurality of nozzles disposed on said booms;

a control system;

a hydraulic control module comprising an electronically operated valve, wherein the valve is in electronic communication with the control system;

a hydraulic motor in communication with the hydraulic control module, wherein operation of the hydraulic motor is controlled by the hydraulic control module;

a positive displacement pump linked to said the hydraulic motor, wherein operation of the positive displacement pump is controlled by the hydraulic motor and wherein the positive displacement pump provides pressurized flow of the liquid solution to said booms;

a square wave signal being communicated from said control system to said electronically operated valve; and said square wave signal being adjustable by an open loop routine of said control system, said routine being immediately executable upon a change in the state of flow through said nozzles in at least one of said booms, said square wave signal being adjustable so as to mitigate pressure changes in said spray system.

2. The spray system of claim 1, wherein the positive displacement pump is a diaphragm pump.

3. The spray system of claim 1, wherein said square wave signal is a pulse width modulated signal.

4. The spray system of claim 1, wherein said spray system is fixed on a vehicle.

5. The spray system of claim 1, wherein said change in state of flow through said nozzles is a change in the flow rate of said liquid solution flowing through said spray system.

6. The spray system of claim 1, wherein said change in state of flow through said nozzles is caused by an opening of a previously closed nozzle.

7. The spray system of claim 1, wherein said change in state of flow through said nozzles is caused by a closing of a previously open nozzle.

8. A system for mitigating pressure changes in a spray system comprising:

a control system having a plurality inputs and at least one square wave signal output;

a speed sensor connected to one of said inputs;

a flow meter connected to one of said inputs;

a plurality of flow nozzles associated with at least one of said inputs;

a positive displacement pump associated with said spray system and having an outlet in selective fluid communication with said flow nozzles; and a control valve linked to said positive displacement pump, said control valve connected to said square wave output of said control system;

said control system having a routine wherein a speed of said positive displacement pump is changed by said control valve via an adjustment of a square wave signal delivered from said control system to said valve, said change being proportional to a sensed change in at least one of said inputs of said control system, and wherein said routine comprises an open loop subroutine which executes immediately upon the occurrence of said sensed change.

9. The system of claim 8, wherein said sensed change is a change detected by said flow meter.

10. The system of claim 8, wherein said square wave signal is a pulse width modulated signal.

11. The system of claim 8, wherein said sensed change is a change in state of at least one of said flow nozzles.

12. A method for mitigating pressure changes in a chemical sprayer system comprising:

monitoring a plurality of spray parameters in said sprayer system;

controlling a positive displacement pump using a valve controlled by a square wave signal; and adjusting the square wave signal to said valve with an open loop subroutine immediately upon detection of a change in the state of at least one of said spray parameters, said adjustment being directly proportional to a target speed of said displacement pump, said target speed being selected based on said detected change in state.

13. The method of claim 12, wherein said detection of a change in state is the detection of a change in the state of a boom control valve of said sprayer system.

14. The method of claim 13, wherein adjusting of the square wave signal takes place prior to finalization of said change in state of said boom control valve of said sprayer system.

15. The method of claim 14, wherein said adjustment to said square wave is proportional to a ratio of nozzles continuing to accept flow after said change in state of said control valve to nozzles no longer accepting flow after said change in sate of said control valve.

16. A method for mitigating pressure changes in a chemical sprayer system comprising:

monitoring a plurality of spray parameters in said sprayer system;

controlling a positive displacement pump using a valve controlled by a square wave signal;

adjusting the square wave signal to said valve upon detection of a change in the state of at least one of said spray parameters, said adjustment being directly proportional to a target speed of said displacement pump, said target speed being selected based on said detected change in state, wherein said detection of a change in state is the detection of a change in the state of a boom control valve of said sprayer system;

wherein adjusting of the square wave signal takes place prior to finalization of said change in state of said boom control valve of said sprayer system; and wherein said adjustment to said square wave is proportional to a ratio of nozzles continuing to accept flow after said change in state of said control valve to nozzles no longer accepting flow after said change in sate of said control valve.

* * * * *